US006357052B1

(12) United States Patent
Fleming

(10) Patent No.: US 6,357,052 B1
(45) Date of Patent: Mar. 19, 2002

(54) FAN NOVELTY HEAD GEAR

(75) Inventor: Ward Fleming, Greene County, NY (US)

(73) Assignee: Fan Hats LLC, Wolfeboro, NH (US)

( * ) Notice: Subject to any disclaimer, the term of this patent is extended or adjusted under 35 U.S.C. 154(b) by 0 days.

(21) Appl. No.: 09/887,755

(22) Filed: Jun. 20, 2001

Related U.S. Application Data

(63) Continuation-in-part of application No. 09/693,089, filed on Oct. 20, 2000, now Pat. No. 6,256,796.

(51) Int. Cl.[7] ..... A42B 1/24

(52) U.S. Cl. ..... 2/209.13; 2/244; 446/27; 446/488

(58) Field of Search ..... 2/209.13, 244, 2/200.3; 446/27, 487, 488

(56) References Cited

U.S. PATENT DOCUMENTS

| | | | | | |
|---|---|---|---|---|---|
| 3,026,525 | A | * | 3/1962 | Gyorfy | 2/424 |
| 5,903,926 | A | * | 5/1999 | Fleming | 2/209.13 |
| D442,746 | S | * | 5/2001 | Belcher | D29/122 |
| 6,256,796 | B1 | * | 7/2001 | Fleming | |

* cited by examiner

*Primary Examiner*—John J. Calvert
*Assistant Examiner*—Katherine Moran
(74) *Attorney, Agent, or Firm*—Howard C. Miskin; Gloria Tsui-Yip

(57) ABSTRACT

A fan novelty device having a removable fan-like structure formed of a strip of pliable material having an accordion folding and a head gear. The fan-like structure is removably attached to a flexible base that conforms to a wearer's head. The base is removably attached to a head gear such as a head band, hair clips, barrettes, hair combs, etc.

13 Claims, 4 Drawing Sheets

FAN NOVELTY HEAD GEAR

This is a continuation in part of application Ser. No. 09/693,089, filed Oct. 20, 2000, now U.S. Pat. No. 6,256,796.

FIELD OF THE INVENTION

The invention relates generally to a novelty device and is particularly related to a novelty headwear having a removable fan-like structure, which can be readily opened and closed as desired. The fan novelty device not only attracts attention but also has entertaining, promotional and marketing values.

BACKGROUND OF THE INVENTION

Various novelty hats are available and have been used for the purpose of attracting attention or for promotional and marketing purposes in the fields of sports and social or political activities. One such novelty hat is described in U.S. Pat. No. 5,903,626 issued May 18, 1999 to Ward Fleming, the inventor named in the present application. The hat described in said patent has a dome-shaped body, e.g. a cap, that fits over the head of the wearer, and a fan-like structure pivotally attached to at least three points, i.e., the front end, the rear end and the center of the come-shaped body as shown therein in FIGS. 2 and 3. The fan-like structure itself is formed of a strip of fabric having an accordion folding. In its closed position, the accordion folding rests on the dome-shaped body and is attached to the surface of the dome-shaped body by various methods or means, such as by adhesive, sewing or stapling, taping, Velcro®, and the like. The disclosure of said patent is fully incorporated herein by reference.

An improvement to the hat disclosed in U.S. Pat. No. 5,903,626 is described in the parent U.S. patent application Ser. No. 09/693,089, filed Oct. 20, 2000. Additional features of the hat of said patent application includes a weighted fin-like member for maintaining the fan-like structure in a fully open position and an enclosure for the fan-like structure. The disclosure of said patent application is fully incorporated herein by reference.

The present invention provides a novelty head gear with a fan-like structure which varies in its construction from the novelty devices described in said patent and patent application, and which may also be used for the purpose of attracting attention, or for promotional and marketing purposes.

The novelty head gear of the present invention constitutes a variation and/or improvement over the heretofore discussed novelty devices, including the novelty hats described in the aforementioned patent and patent application.

SUMMARY OF THE INVENTION

The present invention provides a novelty device comprising a fan-like structure, advantageously removable, attached to at least one head gear. The fan-like structure is formed by a strip of pliable and foldable material having an accordion structure defined by a plurality of fin-like members. The novelty device further comprises a flexible base corresponding to each fan-like structure having substantially the same size and shape as the corresponding fin-like members. The front most fin-like member of the fan-like structure is mounted on the base. Preferably, the base is removably attached to at least one head gear, which can be placed on a wearer's head. The head gear may be a dome-shaped body such as a cap as disclosed in U.S. Pat. No. 5,903,626 and U.S. patent application Ser. No. 09/693,089, or head bands, barrettes, hair combs, rubber bands, hair clips, etc.

When the base of the fan-like structure is mounted on the head gear on a wearer's head, the flexible base conforms to the shape of the wearer's head to allow the free movement or pivoting of the fan-like structure with the movements of the wearer's head. The fan-like structure may be positioned in a front-to-back orientation, such that the wearer's tilt or snap of his or her head backward or forward would open or close the fan-like structure, respectively, or a side-to-side orientation, such that the wearer may tilt or snap his or her head left or right to open or close the fan-like structure.

The accordion folding of the fan-like structure are provided with openings at the fold lines which aid in the pleating and opening of the fan-like structure and improve the structural integrity of the open fan-like structure in windy conditions.

BRIEF DESCRIPTION OF THE DRAWINGS

A preferred embodiment of the present invention has been chosen for purposes of illustration and description and is shown in the accompanying drawings forming a part of the specification wherein.

DETAILED DESCRIPTION OF THE PREFERRED EMBODIMENTS

Figure 1:
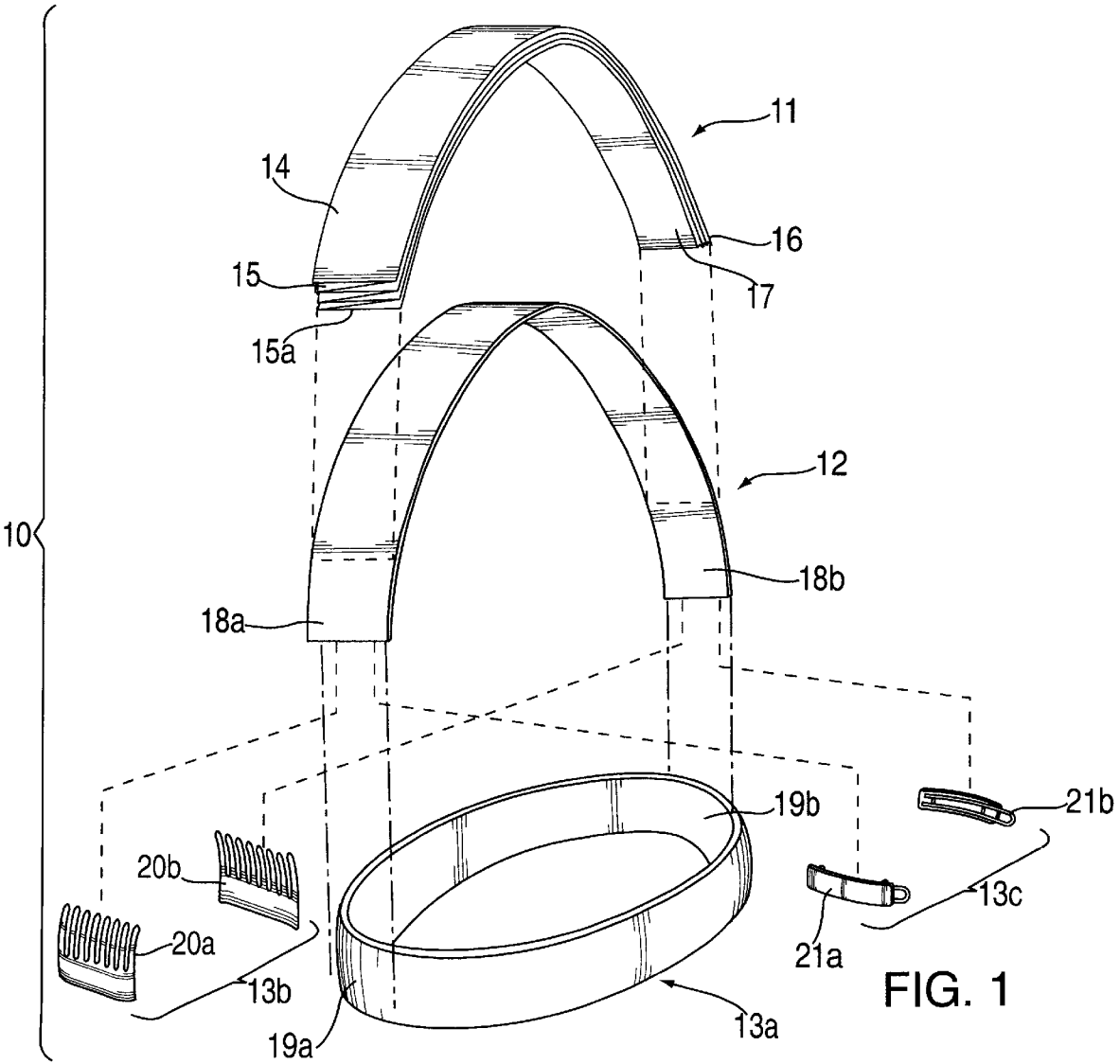
FIG. 1 is an exploded perspective view of the present invention showing the manner of attachment of the fan-like structure in a closed position on a base and then on different types of head gears.

With reference to the drawings, wherein the same reference number indicates the same element throughout, there is shown in FIG. 1 an exploded perspective view of the present invention showing the manner of attachment. FIG. 1 shows the fan novelty device 10 comprising a strip of pliable material 11, a base 12 and a head gear 13 (13*a*, 13*b* or 13*c*).

The strip of pliable material 11 has an accordion folding 14 formed of a plurality of pleated fins 15. The strip of pliable material 11 may be made of fabric, paper or spun bonded polyolefin such as DuPont's Tyvek®. At one end 16, the pleated fins 15 are clasped or attached together to form the pivotal point 17 of the fan-like structure, best shown in FIG. 2. Different designs may be printed-on the strip of material 11 for display (not shown).

Figure 2:
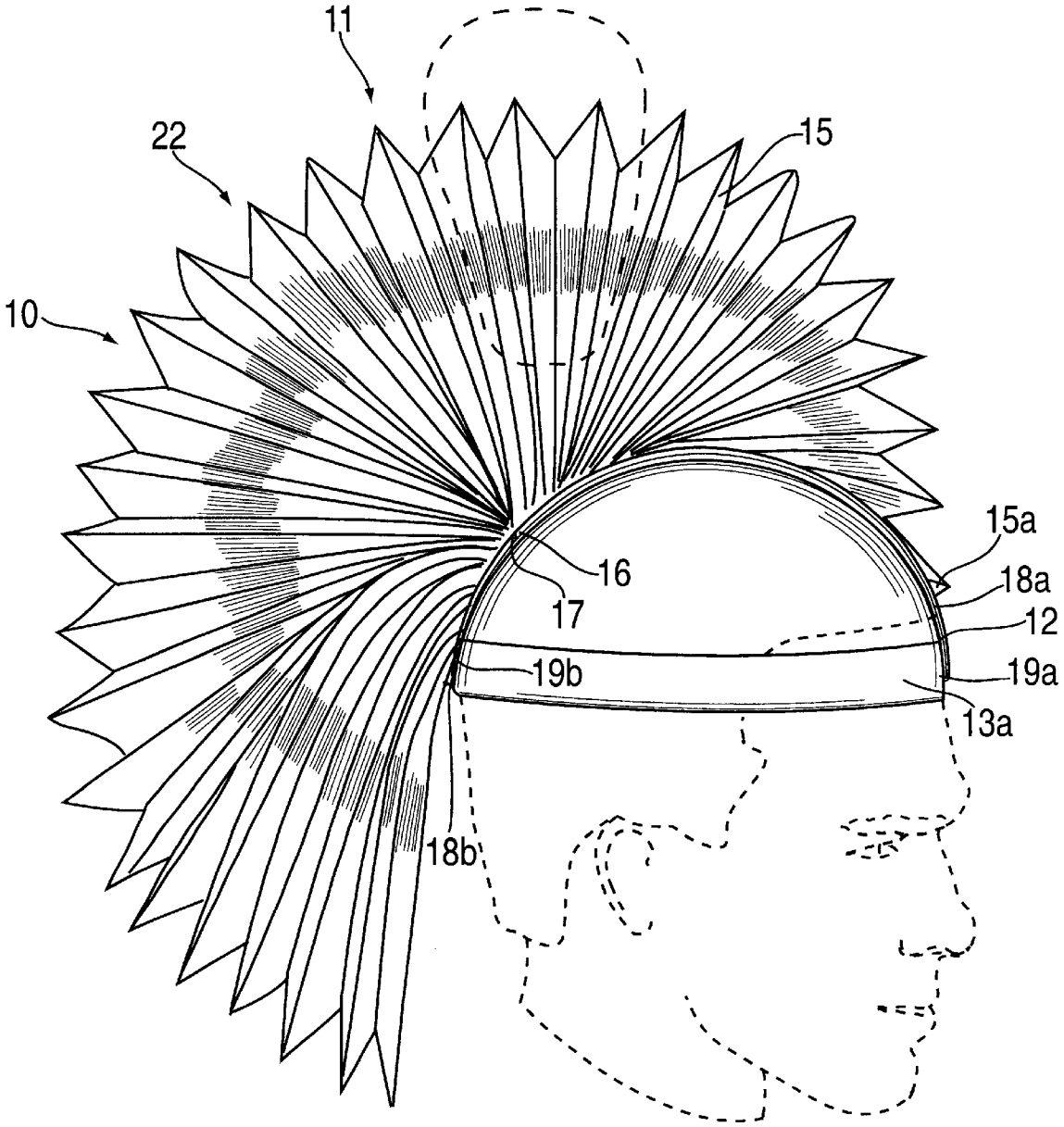
FIG. 2 is a side view of the fan novelty head gear of FIG. 1 on a wearer's head in the front-to-back orientation with the fan-like structure in the open position.

The front most fin 15*a* is attached to base 12 by any means known to one skilled in the art, such as sewing, gluing, stapling, taping, Velcro® attachment, snap buttons, etc. Base 12 is made of a flexible material such that it conforms to a wearer's head as shown in FIG. 2. Base 12 may be made of the same material as the strip of material 11. Base 12 has a shape and size substantially similar to that of the front most fin member 15*a* to provide adequate support for the strip of material 11 when fins 15 are in the open position to form the fan-like structure 22 as shown in FIG. 2.

Opposite ends 18*a* and 18*b* of base 12 are attached to head gear 13 by any means known to one skilled in the art, such as sewing, gluing, stapling, taping, Velcro® attachment, snap buttons, etc. Opposite ends 18*a* and 18*b* of base 12 may be attached to a head band 13*a* at two opposed locations 19*a* and 19*b* or to two hair combs 20*a* and 20*b* or to two barrettes 21*a* and 21*b*. Other types of head gears 13, such as rubber bands, hair clips, etc., suitable for attachment to a wearer's head may be used. Removable attachment means between base 12 and head gear 13 allows the instantaneous changing of different strips of material 11 having fan-like structures 22 of different designs and/or shapes.

FIG. 2 shows a side view of the fan novelty device 10 on a wearer's head with the strip of accordion folded material 11 in an open position to form a fan-like structure 22. In the front-to-back orientation as shown in FIG. 2, the opening of the strip of material 11 from the closed position as shown in FIG. 1 is accomplished by tilting the wearer's head backward such that the fins 15 are pivoted from the pivotal point 16 and expanded to form the fan-like structure 22. The strip of material 11 may also be opened manually by hand.

Figure 3:
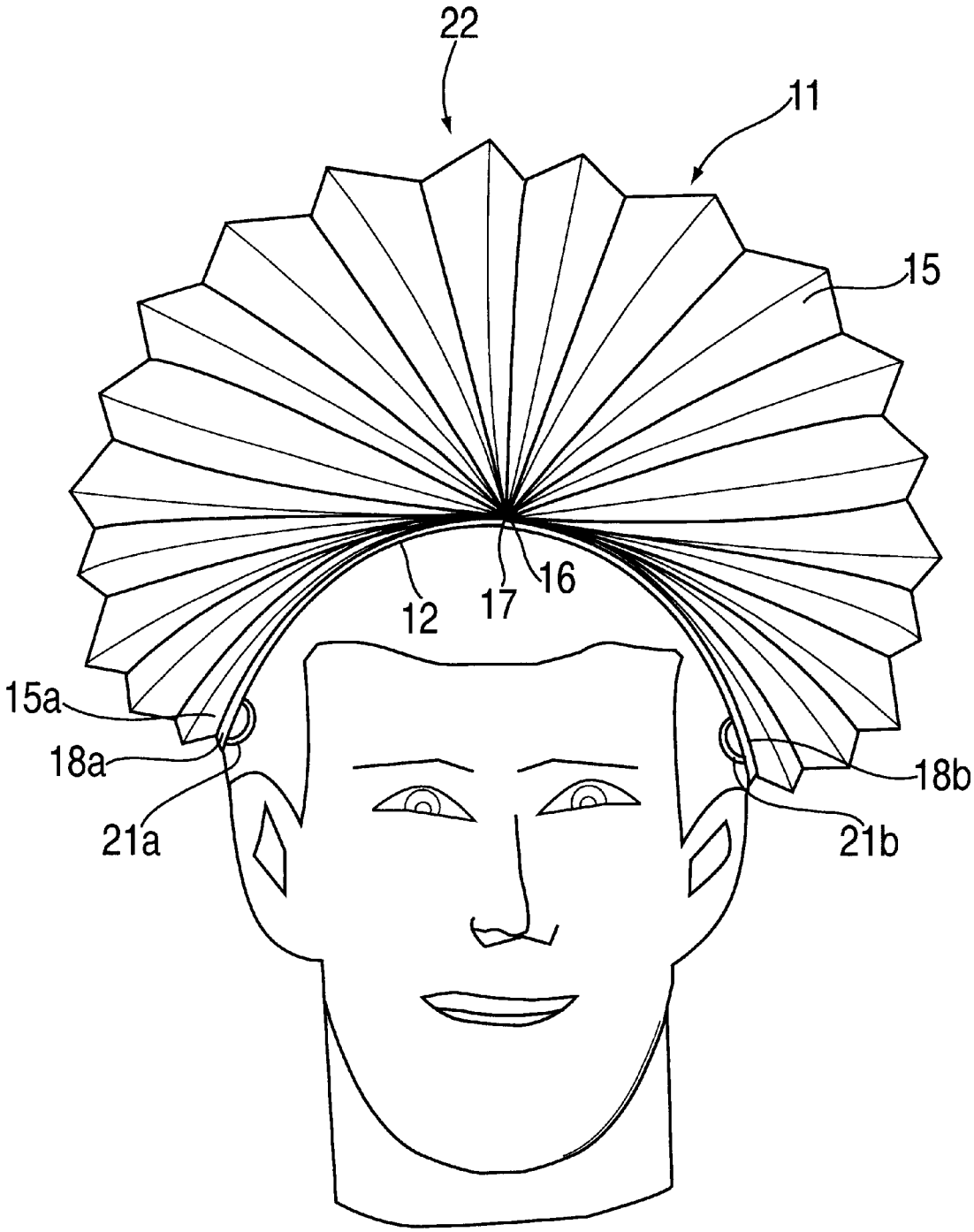
FIG. 3 is a front view of the fan novelty head gear of FIG. 1 on a wearer's head in the side-to-side orientation with the fan-like structure in the open position.

FIG. 3 shows a front view of the fan novelty device 10 on a wearer's head in the side-to-side position. Opposite ends 18*a* and 18*b* of base 12 of the novelty device 10 in FIG. 3 are attached to two barrettes 21*a* and 21*b*, which are positioned on the right and left sides of the wearer's head, respectively. The opening of the strip of material 11 to form the fan-like structure 22 requires the wearer to tilt his/her head from side to side.

An advantage of using a head gear 13 such as head band 13*a*, hair combs 20*a* and 20*b* and barrettes 21*a* and 22*b* as shown above is to allow the fan novelty device 10 to be placed either directly on a wearer's head or on his/her other head gear such as a baseball cap and to allow different positioning and/or orientation of one or more fan-like structures 22 on a wearer's head. Additionally, head gear 13 of the type discussed above are less restrictive on the wearer than a cap disclosed in U.S. Pat. No. 5,903,926 or U.S. patent application Ser. No. 09/693,089. Furthermore, head band 13*a* provides additional area for which promotional or advertising material may be displayed.

Figure 4:
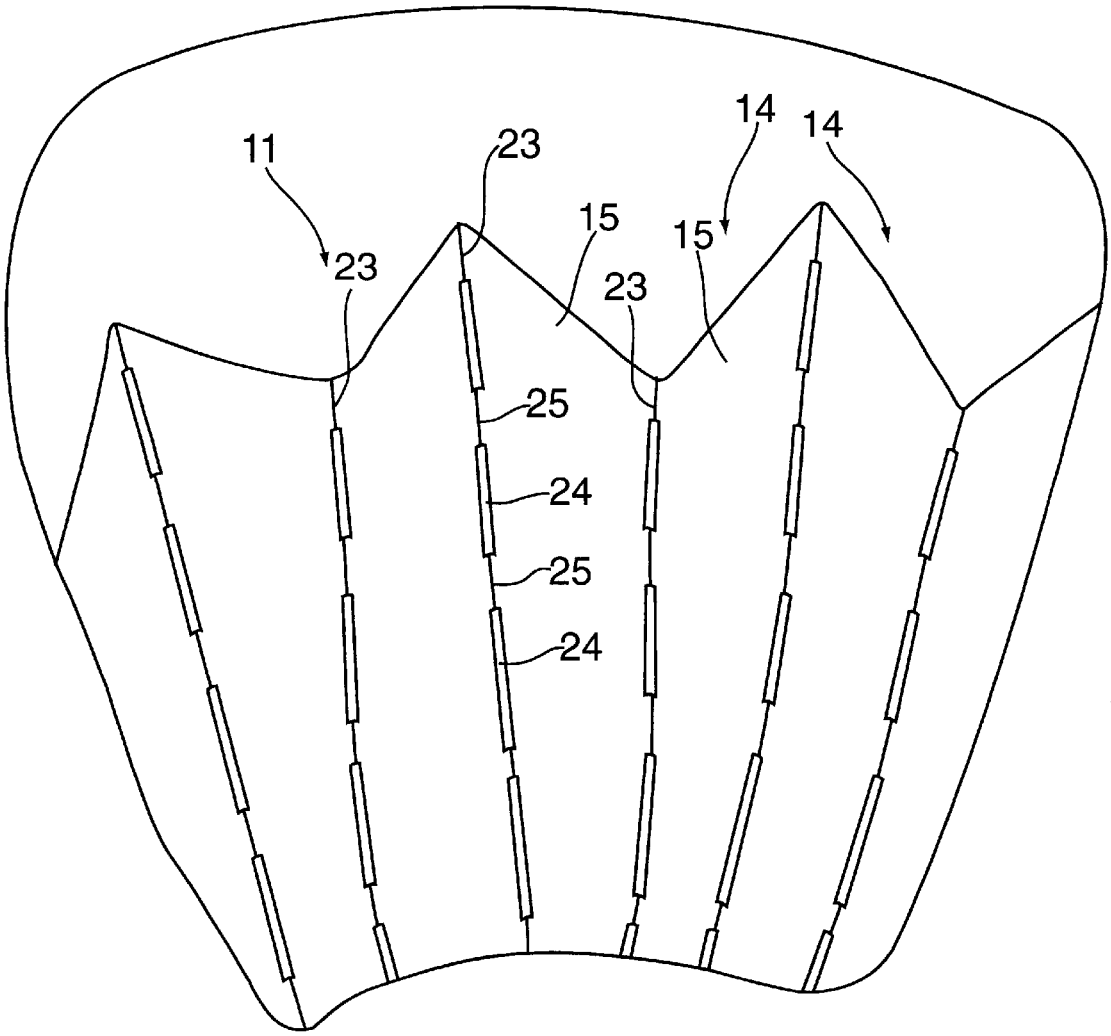
FIG. 4 is a magnified view of a portion of the fan-like structure of FIG. 2 illustrating the openings at the fold lines.

FIG. 4 is a detailed view showing the accordion folding 14 of the strip of material 11. At the fold line 23 formed between a pair of adjacent fins 15 are a plurality of slit openings 24. Alternating with the slit openings 25 along the fold line 23 are a plurality of bridges 25. The slit openings 24 aid in the pleating and opening of the fan-like structure 22 by providing guidelines to the according folding 14. Additionally, the slit openings 24 allow wind to pass through without interfering with the structural integrity of the fan-like structure 22 when it is in the open position. Preferably, a 3 to 1 ratio between opening 24 and bridge 25 is used on every fold line 23 of the strip of material 11. However, different ratios between opening 24 and bridge 25 may be used as long as the bridge 25 is not insubstantial to become a perforation along the fold line 23 and on alternate fold lines 23.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. A fan novelty device for a wearer's head, comprising:

(a) a strip of pliable material being accordion folded and openable to a fan-like structure having a plurality of fin-like members, including a front most fin-like member;

(b) a flexible base substantially the same size and shape as said front most fin-like member that conforms to the wearer's head and having opposite ends;

(c) a head gear for the wearer's head;

(d) means for attaching said front most fin-like member of said strip of material to said base; and (e) means for attaching said opposite ends of said base to said head gear.

2. The device according to claim 1, wherein said head gear is a head band.

3. The device according to claim 1, wherein said head gear comprises two hair combs.

4. The device according to claim 1, wherein said head gear comprises two barrettes.

5. The device according to claim 1 wherein said head gear comprises two hair clips.

6. The device according to claim 1 wherein said strip of pliable material is made of paper.

7. The device according to claim 1 wherein said strip of pliable material is made of fabric.

8. The device according to claim 1 wherein said strip of pliable material is made of spun bonded polyolefin.

9. The device according to claim 1 wherein said strip of pliable material having designs display thereon.

10. The device according to claim 2 wherein said head band having designs display thereon.

11. The device according to claim 1 wherein said accordion folding of said strip of material forms a plurality of fold lines between adjacent fin-like members and further comprising a plurality of openings along at least one fold line.

12. The device according to claim 11 further comprising a plurality of bridges along said at least one fold line, alternating with said plurality of openings.

13. The device according to claim 12 wherein said bridges and said openings are at a one to three ratio.

* * * * *